United States Patent [19]

Deming et al.

[11] 4,048,630

[45] Sept. 13, 1977

[54] DOOR OPERATOR WITH AUTOMATIC CONTROL OF AUXILIARY CIRCUIT

[75] Inventors: Andrew F. Deming, Alliance; Alvin J. Carli, Sebring, both of Ohio

[73] Assignee: The Alliance Manufacturing Co., Inc., Alliance, Ohio

[21] Appl. No.: 651,536

[22] Filed: Jan. 22, 1976

[51] Int. Cl.[2] ..... G08B 13/08

[52] U.S. Cl. ..... 340/274 R; 200/1 B; 200/33 R; 200/61.62; 343/225

[58] Field of Search ..... 343/225; 340/274 R, 340/274 C; 49/25; 318/16; 200/1 B, 33 B, 33 R, 61.62

[56] References Cited

U.S. PATENT DOCUMENTS

| | | | |
|---|---|---|---|
| 528,589 | 11/1894 | Brownell et al. | 340/274 R |
| 2,236,411 | 3/1941 | Metcalf | 200/33 R |
| 2,426,350 | 8/1947 | Harmon | 200/33 R |
| 3,445,848 | 5/1969 | Goldstein | 343/225 |

*Primary Examiner*—Glen R. Swann, III
*Attorney, Agent, or Firm*—Woodling, Krost, Granger & Rust

[57] ABSTRACT

A door operator is disclosed which has a motor connected to open and close a door; for example, a garage door and a lamp is provided to illuminate the interior of the garage. Motor and lamp energization circuits are provided as controlled by switches; for example, a push button switch or a radio controlled switch. An alarm circuit is provided which may be a security alarm; for example, a burglar alarm or fire alarm. The alarm circuit is enabled when the door operator is not being used and the alarm circuit is disabled automatically whenever the door operator is being used. A time delay means is provided to maintain the lamp energized for a time delay period after the door has closed, and while the lamp is energized the alarm circuit is disabled, but as soon as the lamp is extinguished then the alarm circuit is enabled or armed.

20 Claims, 5 Drawing Figures

DOOR OPERATOR WITH AUTOMATIC CONTROL OF AUXILIARY CIRCUIT

BACKGROUND OF THE INVENTION

Garage door operator circuits have been devised which provide a lamp to illuminate the interior of the garage and also time delay means have been provided to delay the deenergization of the lamp after the door is closed. Such door operator circuits have also been able to establish a sequence of door opening, door open, door closing, and door closed conditions.

Security alarm circuits have been provided for buildings such as homes with the alarm system providing security in any number of ways for example, burglar alarms, fire alarms or smoke detectors. Generally, one would prefer the smoke or fire detectors to be operative at all times, but the burglar alarms are usually controlled manually so as to be armed at about the time the householder is leaving the premises and then disarmed at about the time the householder returns. In those homes where the householder leaves the house by a pedestrian door, it is usual to provide some alarm enabling and disabling switch, e.g. a key switch or hidden switch close to such pedestrian door. However, if the householder should leave the house by an attached garage and by his automobile, then this alarm enabling and disabling switch may not be conveniently close to such garage door.

SUMMARY OF THE INVENTION

The invention may be incorporated in a door operator having a motor connected to open and close a door, comprising in combination, a motor energization circuit, a lamp, a lamp energization circuit connected to said lamp, plural switches connected to control said motor and lamp energization circuits, an alarm circuits, and enabling means connecting said alarm circuit to one of said energization circuits so that actuation of one of said switches closes the door and establishes deenergization of said one of said energization circuits and enables said alarm circuit.

An object of the invention is to provide a door operator with circuit means to automatically enable an alarm circuit in accordance with the closing of a door.

Another object of the invention is to provide a door operator with a circuit which automatically disables an alarm circuit upon the opening of a door.

Another object of the invention is to provide a time delay means for enabling an alarm circuit after the closing of a garage door.

Another object of the invention is to provide time delay means in a garage door operator circuit with the delay means holding lamp contacts closed for a delay period after the door has closed, thus maintaining a lamp energized.

Other objects and a fuller understanding of this invention may be had by referring to the following description and claims, taken in conjunction with the accompanying drawings.

DESCRIPTION OF THE PREFERRED EMBODIMENTS

Figures 1, 2:
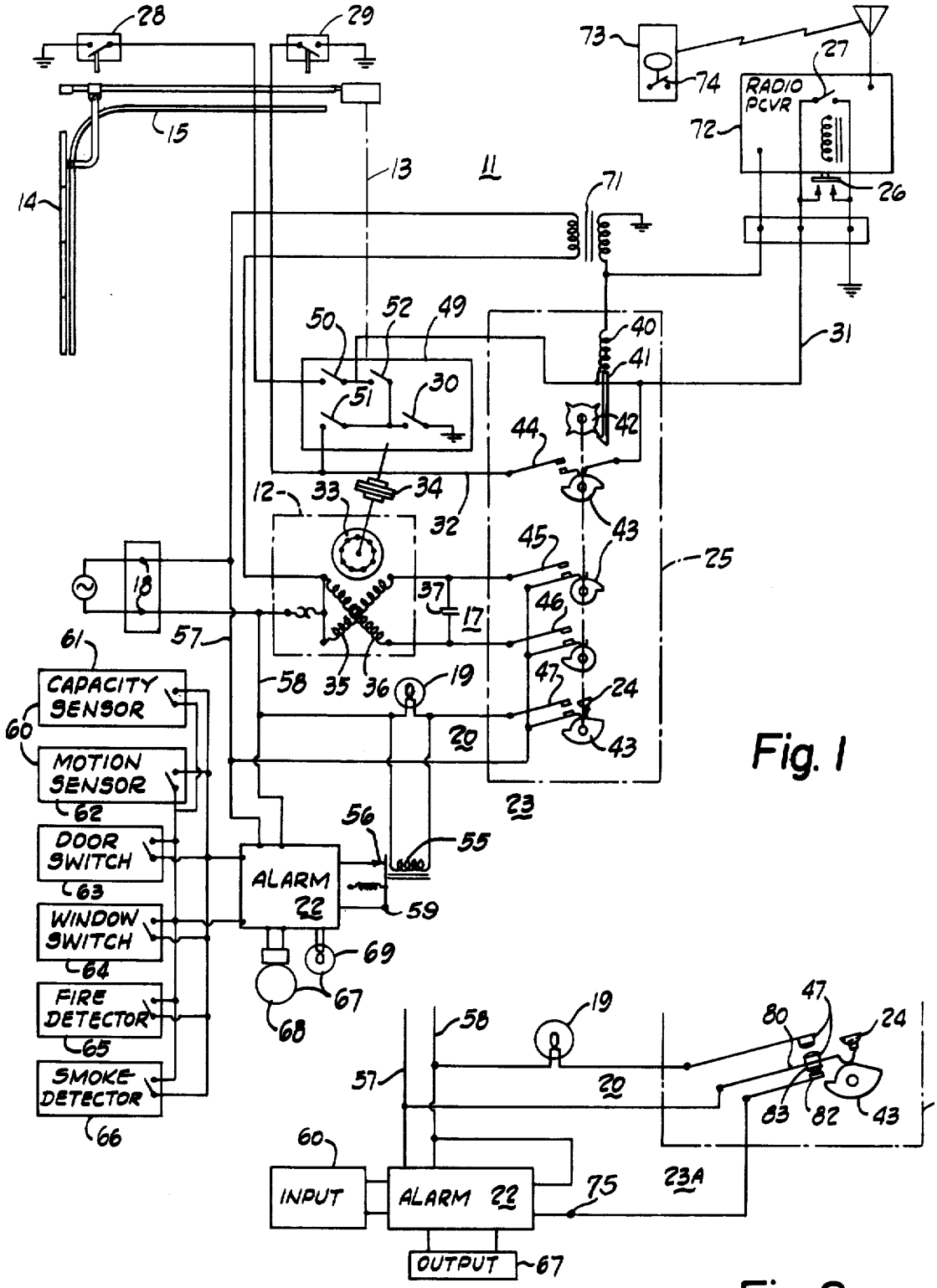
FIG. 1 is a schematic diagram of a garage door circuit embodying the invention.
FIG. 2 is a partial schematic diagram of a modification.

FIG. 1 shows schematically a door operator 11 which includes a motor 12 connected by linkage 13 to a door 14 to open and close this door. The door 14 may be a garage door for example, and move along a track 15.

The door operator 11 also includes a motor energization circuit 17 to energize the motor 12 from voltage source terminals 18. An electric lamp 19 is provided and controlled in energization by a lamp energization circuit 20. An alarm circuit 22 is provided and enabling means 23 is provided to enable and disable the alarm circuit 22. The enabling means 23 includes time delay means 24 and sequencing means 25. A plurality of switches are provided to control the sequencing means 25 and this sequencing means provides a predetermined sequence of door opening, door open, door closing, and door closed conditions. These switches may include a great variety; for example, a manual push button switch 26, a radio receiver switch 27, a down limit switch 28, an up limit switch 29, and an overload or torque switch 30. The closing of any of these switches provides a ground condition on a control conductor 31 to index the sequencing means 25.

The motor energization circuit 17 may be used to energize many different types of motors, and the motor 12 as shown is connected to move the door 14 in opening and closing directions. This reversing direction of the door provided mechanically by the linkage 13 or by an automatically reversing switch within the motor structure or, as shown in FIG. 1, may be provided by the motor energization circuit. The motor 12 shown includes a rotor 33 connected through a clutch 34 as a part of the linkage 13. The motor 12 also includes stator windings 35, 36 and a capacitor 37 for providing the reversible rotation to the rotor 33.

The sequencing means 25 includes an actuating coil 40, a moving armature 41, a ratchet mechanism 42, and a cam mechanism 43 to actuate four sets of contacts 44–47. The contacts 44 are control contacts, contacts 45 and 46 are door up and door down contacts, respectively, and contacts 47 are lamp energization contacts as a part of the lamp energization circuit 20. The torque switch 30 may be a part of a clutch switch mechanism 49 such as the switch structure shown in U.S. Pat. No. 3,719,005 by Alvin J. Carli, issued Mar. 6, 1973; which gives an automatic reversing to the garage door should the door meet some unusual obstruction when moving in the closing direction. This switch mechanism 49 includes a switch 50 which is normally open in the door opening condition and is normally closed in the door closing condition. A switch 51 is also included which is normally open in the door closing condition and normally closed in the door opening condition. A switch 52 is a momentary contact switch which is closed after the door has stopped because of meeting some unexpected obstruction in the closing direction. This gives an extra impulse so that the door energization circuit sequencing means 25 has an extra impulse to ratchet the cam mechanism 43 to the door opening condition.

The alarm circuit 22 is enabled by the enabling means 23. This includes a relay coil 55 connected across the lamp 19 and controlling contacts 56 which are normally closed by a spring to enable output terminal means 59 and are opened by actuation of the coil 55. The alarm circuit 22 may be energized by the closing of the contacts 56 or as shown in FIG. 1 may be energized from conductors 57 and 58 and merely armed or enabled by the closing of the contacts 56. The alarm circuit 22 has one or more input devices 60 shown as switches and these input switches may be of many different types; for example, a capacitance sensor switch 61, a motion sensor switch 62, a door switch 63, a window switch 64, a fire detector switch 65 or a smoke detector switch 66. The alarm circuit 22 also has an output 67 to serve as a warning to observers; for example, an alarm bell 68 or a light 69.

The door operator 11 also includes a step-down transformer 71 with the primary connected to the conductors 57 and 58 for energization from an alternating voltage source and the low voltage secondary providing a suitable low voltage for operation of the sequencing means 25 and a radio receiver 72 which contains the radio receiver switch 27. The system in the preferred embodiments also includes a low powered transmitter having a transmitter switch 74 which may be actuated so that the transmitter emits a signal receivable by the radio receiver 72 and if this is the proper coded signal then the radio receiver switch 27 is closed to actuate the door operator 11.

Figure 3:
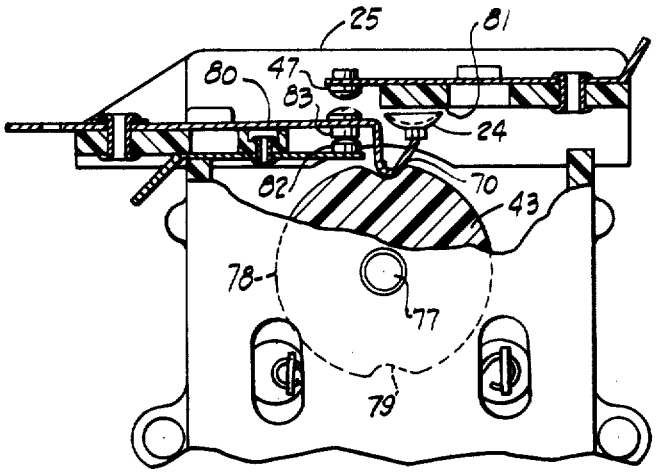
FIG. 3 is a partial view of a sequencing means including a time delay.

The sequencing means 25 may be of many different forms; for example, a solid state circuit having a digital logic input and output, and may also be as shown in FIGS. 1, 2 and 3; namely, an electro-mechanical relay. Such relay is better shown in FIG. 2 and may be of the general type shown in U.S. Pat. No. 3,412,350 by Alvin J. Carli, issued Nov. 19, 1968.

FIG. 3 shows a side elevational view partially in section of such relay, and the cam means 43 is illustrated as rotating around an axis 77 by the ratchet mechanism 42, and not shown in FIG. 2. The sequencing means 25 has a sequence of four conditions: door opening, door open, door closing and door closed. The four conditions may be achieved by one revolution of the cam mechanism 43, as schematically illustrated in FIG. 1, or may be achieved by one-half revolution of the cam as illustrated in FIG. 3. Any multiple of these four conditions may be established around the periphery of the cam mechanism 43. FIG. 3 illustrates the contacts 47 which control the electric lamp 19 and the cam 43 is shown as having a lobe 78 for the three consecutive conditions of door opening, door open, door closing, and then having a cam null 79 for the door closed condition. The movable contact blade 80 which is moved by the cam 43 has an extension mounting the time delay means 24, shown in FIG. 3 as a suction cup which engages a fixed flat surface 81 which is a part of the contact blade mounting structure. Thus, when the cam 43 rotates clockwise, the contact blade 80 is cammed by the lobe 78 to close the contacts as the same time the suction cup is pressed against the flat surface 81. When one-half revolution has been completed, this signals the door closed condition and without the suction cup 24 the contacts 47 would open to extinguish the lamp 19. However, the suction cup provides a time delay means so that the lamp remains energized. This time delay period may be made a suitable length of time by choice of the material and durometer of the suction cup 24 and the smoothness and surface characteristics of the flat surface 81. Such lamp 19 provides illumination; for example, inside a garage so that a person has time to alight from his automobile and depart from the garage.

OPERATION

The door operator 11 provides a means for a time delay of illumination of the lamp 19 after the door 14 has been closed and also provides a means to enable and disable the alarm circuit 22. If one is planning to leave the premises by automobile one might go to the attached garage and press the push button switch 26. This places a ground condition on the control conductor 31 which energizes the actuating coil 40 and by means of the ratchet mechanism 42 the sequencing means 25 is indexed to the first of four conditions, namely the door opening condition. In such condition the contacts 44, 45 and 47 are closed. Closing of contacts 45 directly energizes the motor winding 35 and energizes the winding 36 through the capacitor 37 for rotation of the rotor 33 in the door opening direction. Closure of the contacts 47 illuminates the lamp 19 to illuminate the interior of the garage. Closure of the contacts 44 connects a conductor 32 to the control conductor 31 so that the up limit switch 29 is enabled and so that the clutch switch mechanism 49 is enabled which includes the torque switch 30. Thus if an overload condition should exist on the door during the opening direction, the clutch 34 will slip and the torque switch 30 will close to impulse or index the sequencing means 25 and this will be the door open or door stopped condition. Under normal conditions the door would continue until it reached the up limit switch 29 whereat another impulse is given to the sequencing means to achieve the door open condition. In this condition, the contacts 44, 45 and 46 are open and contact 47 is closed to keep the interior of the garage illuminated.

The house holder may then drive out of the garage and in order to close the door the drive would press the transmitter switch 74 in the transmitter 73 in his automobile and this would emit a signal received by the receiver 72 to close the receiver switch 27. This again places a ground condition on the control conductor 31 to index the sequencing means 25 for the door closing condition. In this condition, the contacts 44, 46 and 47 are closed and the closure of contacts 46 energizes the motor winding 36 directly and energizes winding 35 indirectly through the capacitor 37. This makes the rotor 33 rotate in the opposite direction for the door closing condition. The closing of the contacts 44 enables the clutch switch mechanism 49. This provides the overload function as before and in addition in the door closing direction this switch mechanism 49 provides for an automatic reversal of the door, not merely a stopping of the door, should it meet an obstruction less than about two inches from the completely closed condition. This obstruction would again close the torque switch 30 to impulse this sequencing means 25 to the next condition which is a door closed or door stopped condition. In addition, the clutch switch mechanism provides a second impulse by the momentary closure of the switch 52 after the door has been stopped. This second impulse again indexes the sequencing mechanism 25 to again establish the door opening condition. Thus, a person or a pet cannot be trapped under the closing door. In normal operation however, this safety feature does not come into play and the door closes against the door sill with the door closed condition of the sequencing means 25 established. In this door closed condition, all contacts 44, 45, 46 and 47 are conditioned by their respective cams to be in the open condition. However, the suction cup 24 maintains contacts 47 closed for the pre-determined time delay period.

The alarm circuit 22 is enabled and disabled in accordance with the sequencing means 25 which controls the motor energization circuit 17 and the lamp energization circuit 20 and in turn is controlled by the plurality of switches 26, 27, 28, 29, 30, 50, 51 and 52. Upon disabling of one of the motor energization circuit and lamp energization circuit 17 and 20, respectively, the alarm circuit 22 is enabled. As shown in the preferred embodiment of FIG. 1, this enabling of the alarm circuit is effected at the time of the de-energization of the lamp 19. This is after the time delay established by the suction cup 24. For many types of alarm devices; for example, the fire or smoke detectors, it may not be necessary nor desirable to have the time delay. Accordingly, the enabling or arming of the alarm circuit 22 may be conditioned directly from the motor energization circuit 17 or from the lamp energization 20 with or without the time delay. For other types of alarm circuit inputs the time delay is definitely desirable; for example, if some form of presence detector is utilized inside the garage. If the motion sensor switch 62 or the capacity sensor switch 61 were provided, and with no time delay, then one would not be able to drive into the garage, get out of the car and get into the house without setting off the alarm. The capacity sensor switch 61 may sense the change of capacitance relative to the automobile thus detecting movement of a person near the automobile. The motion sensor switch 62 may be a radio frequency signal or an ultrasonic signal filling the interior of the garage to sense the motion of a person within the garage. Accordingly, if the time delay 24 is not provided, this is a disadvantage because the person cannot drive into the garage and press the transmitter switch 74 to close the door because otherwise he would have to hurry out of the car and get completely out of the garage before the door is closed, else the alarm circuit 22 would be enabled immediately upon closing of the door 14 and the alarm would be set off by that person's movement or presence. The preferred embodiment therefore includes the time delay which not only illuminates the garage for a time period to help the person alight from his automobile, but also delays the enabling of the alarm circuit 22.

Many alarm circuits contain a time delay of output 67, but this is for a different purpose. If one has a detached garage, for example, the pedestrian homeowner entering the garage which has a presence detector input to the alarm does not want the alarm to sound. Thus, the time delayed output of the alarm provides time for the homeowner to reach a concealed disabling switch to turn off the alarm so he can enter his automobile.

FIG. 2 shows a modification of the enabling means 23A and shows only the lower portion of the circuit of FIG. 1. The lamp energization circuit 20 remains the same with the cam 43 actuating the contacts 47 to energize and de-energize the lamp 19. An additional contact 82 is carried by a blade for engagement with a contact 83 on the contact blade 80. These contacts 82 and 83 are normally closed in the position shown in FIG. 2; namely, the door closed condition and are opened in the three other conditions of door opening, door open, and door closing. Thus, for the door closed condition the closed contacts 82 and 83 provide enabling of the alarm circuit 22 at the output terminal means 75. This may be an internal enabling of the alarm circuit 22 or may be the providing of electrical energization to this alarm circuit, as desired. FIG. 3 shows the mounting of these contacts 82 and 83 in the sequencing means 25, where the circuit of FIG. 2 is desired to be used.

Figure 5:
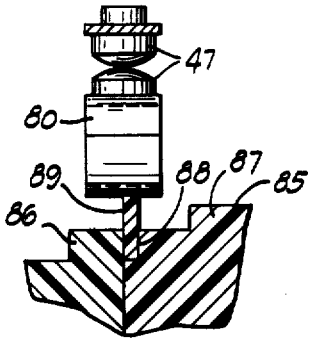
FIG. 5 is a sectional view on the line 5—5 of FIG. 4.
Figure 4:
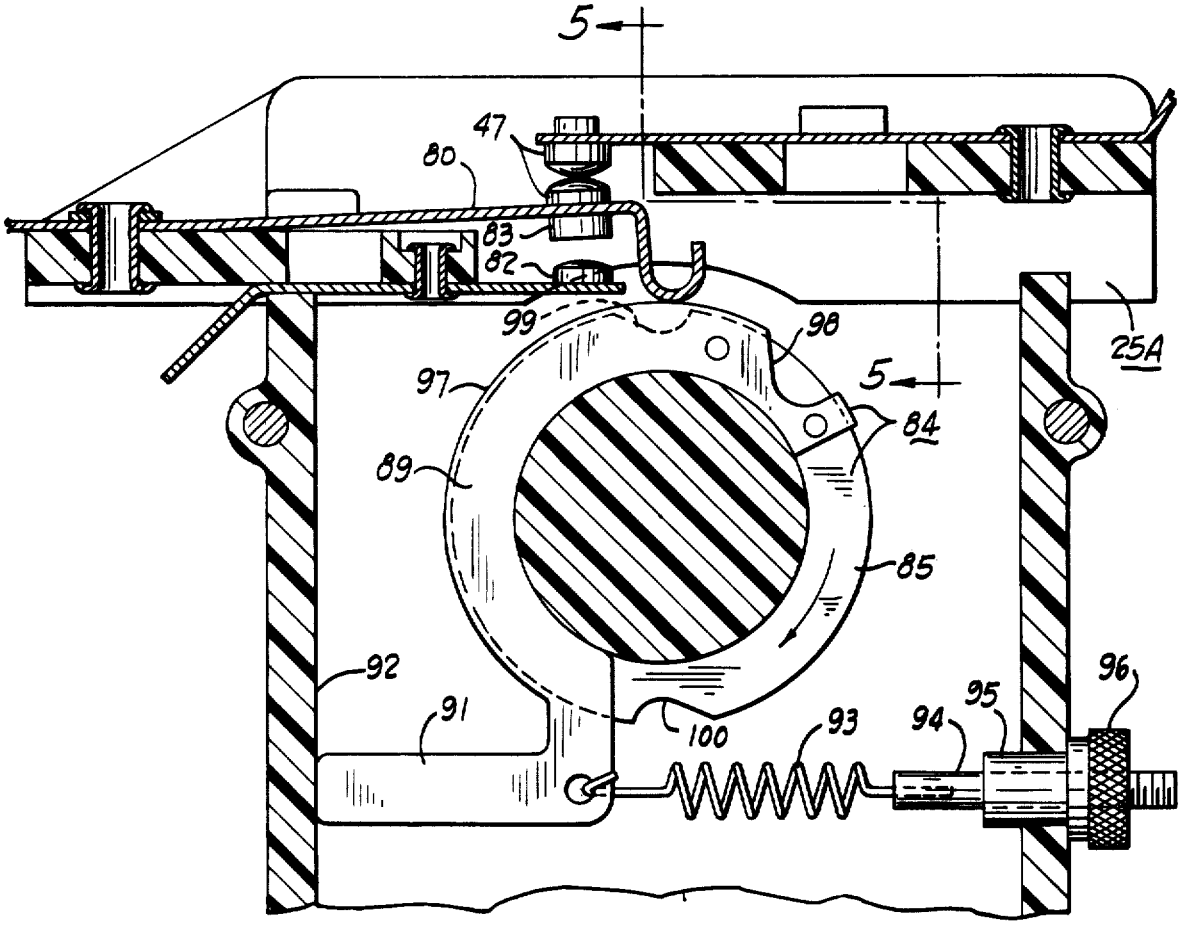
FIG. 4 is a partial sectional view through a modified sequencing means incorporating another time delay.

FIGS. 4 and 5 show another embodiment of the invention wherein the sequencing means 25A incorporates a different time delay means 84. Again the sequencing means 25A is shown as an electromechanical relay similar to the relay of FIG. 2. FIG. 5 shows that the cam mechanism is a drum cam 85 made in two parts 86 and 87 to establish therebetween a groove 88. An arcuate member 89 is a part of the time delay means 84 and is disposed in the groove 88. The drum cam 85 may be of molded plastic material; for example, a nylon and the arcuate member 89 may also be of plastic material; for example, delrin. The arcuate member 89 is disposed in about two hundred degrees of the periphery of the groove 88 and fits closely therewithin; for example, with 0.002 to 0.005 inches of clearance. The space between the arcuate member 89 and the walls of the groove 88 is preferably filled with a silicone fluid or silicone grease with the silicone fluid being preferred. Such a silicone fluid has a property of wetting the surfaces and its adhesion is greater than its cohesion so that the liquid does not tend to drip out of the groove 88, but remains in places wetting the surfaces, so it does not evaporate nor deteriorate.

The arcuate member 89 has an extension 91 which may abut the inside of the case 92 of the sequencing means 25A as a stop for the arcuate movement. A spring 93 is fastened to the arcuate member 89 and to an adjustable screw 94. The screw 94 passes through a bushing 95 in the case 92 and an adjusting nut 96 threaded on the outside of the screw 94 provides for adjustment of tension of the spring 93. The arcuate member 89 has an outer circular edge 97 and also has a cam null 98 near the clockwise end of the member 89. The peripheral edge 97 extends radially outwardly from the lobe of the cam 85 by a small amount; for example, 0.005 to 0.010 inches. This drum cam 85 has the two cam nulls 99 and 100 similar to the cam nulls 79 in the cam of FIG. 3. These nulls 99 and 100 would normally provide the lamp de-energized condition for the door closed condition of the sequencing means 25A. However, the cam drum 85 rotates clockwise during its indexing movement and this clockwise movement drags with it the arcuate member 89 against the urging of the spring 93 because of the viscosity of the silicone fluid and the friction between the arcuate member 89, the silicone fluid and the cam drum 85. Thus, the arcuate member 89 is rotated clockwise with the cam drum 85 until the extension 91 abuts the inside of the case 92. Because of this position of member 89 the contact blade is urged upwardly by the periphery 97 of the arcuate member 89 and the contacts 47 remain closed. It is only after the predetermined time delay that the urging of the spring 93 causes the arcuate member 89 to move slowly counter clockwise that the contacts 47 will open. This will be because the cam null 98 on the arcuate member 89 will, after such time period, coincide in angular position with the cam null 99 of the cam drum 85. Contacts 82 and 83 are also shown in FIG. 4, if these are desired for the circuit of FIG. 2.

The FIGS. 3, 4 and 5 show two different time delay means whereby the same contacts 47 which control the energization and de-energization of the lamp 19 may be made to have a time delay opening before de-energization of this lamp. In both cases the de-energization of the lamp may be utilized to enable the alarm circuit 22 shown in FIGS. 1 and 2.

This time delay means 24 or 84 establishes a lamp deenergized condition for at least part of the door closed condition and the alarm circuit 22 is armed during at least part of the door closed condition. In the preferred embodiment the time delay means is connected to establish a lamp energized condition for the initial portion of the door closed condition and thereafter arms the alarm circuit 22. The time delay means is a suction cup 24 in the embodiment of FIG. 3 and a resiliently urged arcuate member 89 in FIGS. 4 and 5.

FIG. 2 shows contacts 47 and 82 which are actuated by the sequencing means 25 as double throw contacts. When contacts 47 are closed, contacts 82 and 83 are open, and when contacts 82 and 83 are closed, contacts 47 are open. The sequencing means 25 acts to open contacts 47 to disable one of the energization circuits, shown as the lamp energization circuit 20, and to enable the output terminal means 75. This enables the alarm circuit 22.

A similar circuit is provided in FIG. 1, wherein when contacts 47 are closed, contacts 56 are open, and when contacts 47 are open, contacts 56 are closed, for a double throw condition. The closing of the contacts 56 enables the output terminal means 59 to enable the alarm circuit 22.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of the circuit and the combination and arrangement of circuit elements may be resorted to without departing from the spirit and scope of the invention as hereinafter claimed.

What is claimed is:

1. A door operator having a motor connected to open and close a door, comprising, in combination, a motor energization circuit, a lamp, a lamp energization circuit connected to said lamp, plural switches connected to control said motor and lamp energization circuits, an alarm circuit, and enabling means connecting said alarm circuit to one of said energization circuits so that actuation of one of said switches closes the door and establishes de-energization of said one of said energization circuits and enables said alarm circuit.

2. A door operator as set forth in claim 1, wherein said enabling means connects said alarm circuit to said lamp energization circuit.

3. A door operator as set forth in claim 1, wherein said enabling means includes time delay means.

4. A door operator as set forth in claim 1, wherein said enabling means includes sequencing means controlling the motor energization means for door opening, door open, door closing, and door closed condition.

5. A door operator as set forth in claim 3, wherein said time delay means is connected to delay the enabling of said alarm circuit until expiration of a time delay period after said door is closed.

6. A door operator as set forth in claim 5, wherein said time delay means is connected to delay the de-energization of said lamp.

7. A door operator as set forth in claim 1, wherein actuation of one of said switches disables said alarm circuit and enables said motor energization circuit to cause the motor to open the door.

8. A door operator as set forth in claim 1, wherein said enabling means includes sequencing means connected to control said motor for door opening, door open, door closing, and door closed conditions, and means connecting said sequencing means to control said motor energization circuit and said lamp energization circuit.

9. A door operator having a motor connected to move the door in opening and closing directions, comprising, in combination, sequencing means connected to selectively energize and de-energize said motor from a voltage source in a predetermined sequence of door opening, door open, door closing, and door closed conditions, an electric lamp, means connecting said sequencing means to energize said lamp during said door opening, door open, and door closing conditions and to establish a lamp de-energized condition for at least part of said door closed condition, and alarm means connected to be armed by said sequencing means during said at least part of said door closed condition.

10. A door operator as set forth in claim 9, including time delay means to maintain said lamp energized during a portion of said door closed condition.

11. A door operator as set forth in claim 10, wherein said time delay means is connected to establish a lamp energized condition for the initial portion of said door closed condition and thereafter to arm said alarm means.

12. A door operator having a motor connected to move the door in opening and closing directions comprising, in combination, motor energization contact means connected to said motor and to voltage terminal means to establish energization of said motor upon said contact means being closed, an electric lamp, lamp energization contacts connected to said lamp and to said voltage terminal means to establish energization of said lamp upon said contacts being closed, sequencer means to actuate said contact means to establish sequentially door moving and door stationary conditions and said sequencer means also actuating said lamp contacts independently of said contact means to establish a lamp energized condition for at least part of the door moving condition and a lamp off condition for at least part of the door stationary condition, and delay means in said door operator for holding said lamp contacts closed for a delay period after a door stationary condition is established.

13. A door operator as set forth in claim 12, wherein said door moving condition includes door opening and closing conditions and said door stationary condition includes door open and door closed conditions, and said sequencer means establishes sequentially door opening, door open, door closing, and door closed conditions with said lamp energized condition being established for the door opening, door open, and door closing conditions.

14. A door operator as set forth in claim 13, wherein said sequencer means establishes said lamp off condition for said door closed condition.

15. A door operator as set forth in claim 12, wherein said delay means includes a suction cup.

16. A door operator as set forth in claim 12, wherein said sequencer means includes a rotary member moved through an angular movement to establish said sequential conditions, and said delay means includes an arcuate member frictionally engaging said rotary member, and resilient means urging said arcuate member in a direction opposite so that imparted to said arcuate member by movement of said rotary member.

17. A door operator having a motor connected to move the door in opening and closing directions, comprising in combination:

plural contact means including first and second contact means, a motor energization circuit including at least one of said contact means connected to the motor and to voltage terminal means to establish energization of the motor, an electric lamp, a lamp energization circuit including at least one of said contact means connected to said lamp and to said voltage terminal means to establish energization of said lamp, sequencer means connected to actuate said contact means to establish sequentially door moving and door stationary conditions and to establish a lamp energized condition for at least a part of said door moving condition and a lamp off condition for at least part of said door stationary condition, said sequencer means connected to actuate said first and second contact means as double throw contacts with one enabled substantially concurrently with the disabling of the other, means connecting said first contact means in one of said energization circuits, and means connecting said second contact means to output terminal means to establish enabling of said output terminal means upon disabling of said one of said energization circuits.

18. A door operator as set forth in claim 17, wherein said one of said energization circuits is said lamp energization circuit.

19. A door operator as set forth in claim 17, including a supplementary circuit connected to said output terminal means.

20. A door operator as set forth in claim 17, including an alarm circuit connected to said output terminal means to be enabled and disabled in accordance with said second contact means.

* * * * *